United States Patent [19]

Basile et al.

[11] 4,196,828

[45] Apr. 8, 1980

[54] MANUALLY CHARGED FLUID DISPENSER HAVING A HYDRAULICALLY BIASED CHARGING ROD

[75] Inventors: Peter A. Basile, Hudson; Carl E. Bochmann, Brecksville; Jack Halbeisen, Hudson, all of Ohio

[73] Assignee: The Clorox Company, Oakland, Calif.

[21] Appl. No.: 2,383

[22] Filed: Jan. 10, 1979

[51] Int. Cl.[2] ..... B67D 5/42

[52] U.S. Cl. ..... 222/340; 222/385; 417/305

[58] Field of Search ..... 222/321, 335, 340, 341, 222/380, 383, 385; 239/321; 417/305, 328

[56] References Cited

U.S. PATENT DOCUMENTS

| | | | |
|---|---|---|---|
| Re. 29,176 | 4/1977 | Loeffler | 111/18 |
| 1,080,835 | 9/1912 | Kelley | 222/325 |
| 1,396,494 | 11/1921 | Wright | 417/284 |
| 1,616,077 | 11/1925 | Curtis | 222/400 A |
| 1,730,684 | 8/1927 | Phillips | 222/321 |
| 1,751,128 | 10/1927 | Cocks | 222/327 |
| 2,982,443 | 5/1961 | Ellis | 222/1 |
| 3,471,065 | 10/1969 | Malone | 222/321 |
| 3,514,017 | 5/1970 | Malone | 222/340 X |
| 3,797,748 | 3/1974 | Nozawa et al. | 239/321 |
| 3,799,448 | 3/1974 | Nozawa et al. | 239/321 |
| 3,979,027 | 9/1976 | Loeffler | 222/630 |
| 3,998,361 | 12/1976 | Arena | 222/182 |

*Primary Examiner*—Allen N. Knowles
*Assistant Examiner*—Fred A. Silverberg
*Attorney, Agent, or Firm*—Phillips, Moore, Weissenberger, Lempio & Majestic

[57] ABSTRACT

A manually charged fluid dispenser includes a charging cylinder disposed in the mouth of a bottle and a manually reciprocable piston carried on a charging rod which extends out each end of the cylinder. The charging rod has a differential diameter for providing hydraulic return thereof by fluid pressure in the charging tube after manual charging of the tube. The charging tube is in fluid communication with a spray nozzle mounted on the bottle and tube through a ball valve which is selectively unseatable by a cam actuated by a slidable trigger, which is hydraulically biased by a piston which is in connection with pressurized fluid at the ball valve. An alternative embodiment of the charging cylinder provides a charging rod slidable in a draw tube disposed above an end of a charging cylinder and a piston slidable therein so that fluid pressure in the cylinder will return the rod to its rest position.

20 Claims, 5 Drawing Figures

MANUALLY CHARGED FLUID DISPENSER HAVING A HYDRAULICALLY BIASED CHARGING ROD

BACKGROUND OF THE INVENTION

This invention relates to the field of manually chargable fluid dispensers. Such devices typically comprise a container having a charging cylinder disposed therein which extends through the top opening or mouth of the container. The charging tube is provided with a piston reciprocable therein which is spring biased toward one end of the cylinder, and is slidably carried on an axial charging rod which includes a piston engaging flange for manual sliding of the piston in the cylinder against the force of the biasing spring. The end of the cylinder in opposition to the biasing spring and charging piston communicates with the container interior through a dip tube and a check valve, for communication of fluid to the cylinder upon manual operation of the piston whereupon fluid in the cylinder will be pressurized by the piston bias spring operating on the piston.

Prior art devices have also included a charging rod return spring disposed coaxially thereon for return of the charging rod to its telescoped orientation within the charging cylinder upon completion of the manual charging cycle. Such prior art arrangements not only require an additional return spring, and spring engaging means on the charging rod, but also increase charging forces since the charging piston must be manually withdrawn in the charging cylinder against not only the force of the piston biasing spring, but also the charging rod return spring.

Such prior art charging devices have also typically provided for release of fluid from the charged cylinder through an end of the cylinder and suitable valving means provided therein. It has been found that such arrangements are unduly awkward to operate and result in a valve actuator that requires awkward finger motion, and does not provide for visually cueable spray nozzles.

SUMMARY OF THE INVENTION

Accordingly, it is an object of the present invention to provide a manually chargable fluid dispenser which avoids unnecessarily high charge loading forces.

A further object of this invention to provide such a spray device which does not require manual charging against the force of a return spring.

Still another object of the present invention is to provide a manually chargable fluid dispenser in which the charging rod is self stowing.

Still another object of this invention is to provide such a manually chargable sprayer in which the pull force on the charging rod will provide an indication of system condition.

A further object of this invention is to provide a manually chargable fluid sprayer which may be easily gripped with one hand and actuated for release of fluid from the charging cylinder by actuating a finger trigger while gripping the sprayer.

Another object of this invention is to provide such a sprayer system in which the trigger actuating forces are maintained at a constant low force for ease of actuation thereof.

A further object of this invention is to provide such a sprayer system which includes a visually cueable spray nozzle which will direct discharged fluid in a direction correlated to the direction of trigger actuation.

Still another object of this invention is to provide such a sprayer device in which the trigger actuation requires a short stroke at a very low load.

These and other objects and advantages are provided by the device of the present invention which provides a bottle-shaped container having an upward opening mouth which is arranged to receive a charging cylinder therein. The cylinder is provided with an axial charging rod which extends out each end of the cylinder in sealed sliding engagement therewith. The upper end of the charging rod which exits the end of the cylinder has a reduced diameter compared with the lower portion, and is provided with a handle for manual sliding actuation thereof. The lower end of the charging rod which exits into the interior of the bottle is differentially larger than the upper end so that pressurized fluid in the charging cylinder will act differentially on the charging rod to urge it downward into its retracted position within the charging cylinder, for automatic return thereof after charging of the cylinder. A piston mounted slidably on the charging rod on the reduced diameter portion thereof is engageable by a flange provided on the charging rod for withdrawal of the piston in the charging cylinder against the force of a piston biasing spring disposed in the cylinder between the piston and the upper end of the cylinder.

An alternative embodiment of the charging cylinder provides a cylinder adapted for depending into a bottle and a draw tube mounted on one end of the cylinder and having a charging rod reciprocable therein. One end of the charging rod extends from the draw tube into the end of the cylinder and is arranged to engage a piston and advance it down the charging cylinder against the force of a biasing spring as the charging rod is manually moved toward the cylinder, an orifice and check valve in the piston allows fluid to advance to the upper end of the charging cylinder as the piston is advanced therethrough where it will be pressurized by the bias spring and piston upon release of the charging rod.

Upon release of the charging rod, pressurized fluid in the upper end of the charging cylinder will exert a hydraulic force on the end of the charging rod to return it to its initial position.

Fluid is dischargeable from the cylinder to a fluid discharge passage which communicates from the lower end of the cylinder below the charging piston upwards along one side of the charging cylinder and through the bottle mouth to a dispenser head disposed on the upper end of the charging cylinder and coupled to the bottle mouth, where it is connected to a radial discharge passage provided in the dispenser head.

A nozzle assembly is secured to the discharge head by means of a stem disposed in the discharge passage which provides a seat for a ball valve displaceable therefrom by a pin attached to a piston slidable in a cylinder which is in communication with pressurized fluid in the discharge passage for biasing of the pin and piston against a slidable cam surface provided on a trigger member disposed in one side of the discharge head below the radial discharge passage.

Such an arrangement provides for automatic hydraulic return of the charging rod upon charging of the charging cylinder and thus avoids the requirement for a charging rod return spring. Thus, the only force on the charging rod during charging is that exerted by the piston bias spring.

This arrangement also provides an elongated neck portion of the dispenser which may be easily gripped by one hand which can then operate the trigger disposed in the dispenser head to merely unseat the ball valve through the cam linkage to discharge pressurized fluid through the radial discharge passage and spray nozzle.

DESCRIPTION OF THE PREFERRED EMBODIMENTS

Figure 1:
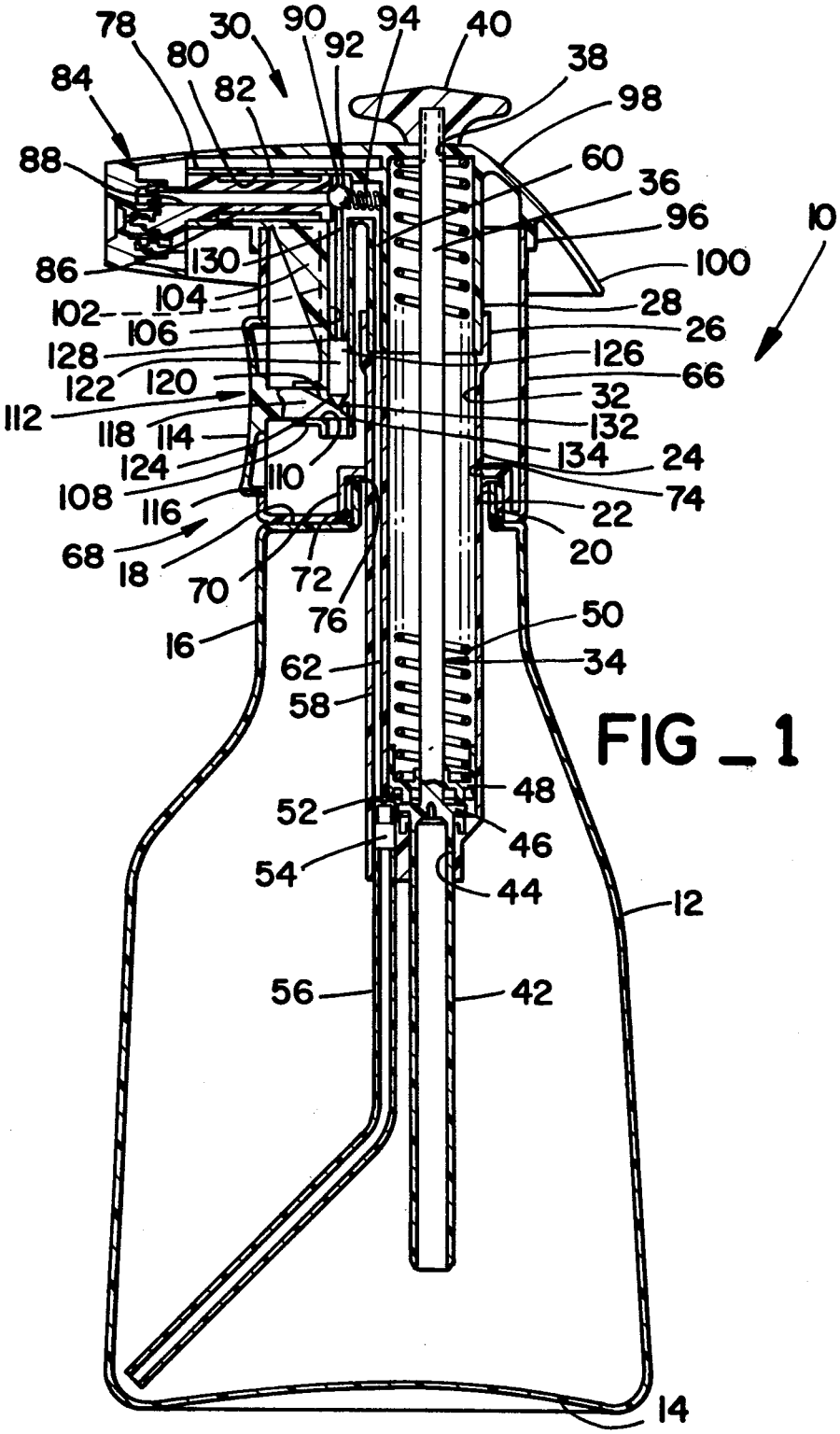
FIG. 1 is a sectional view of a fluid dispenser embodying the present invention.
Figure 2:
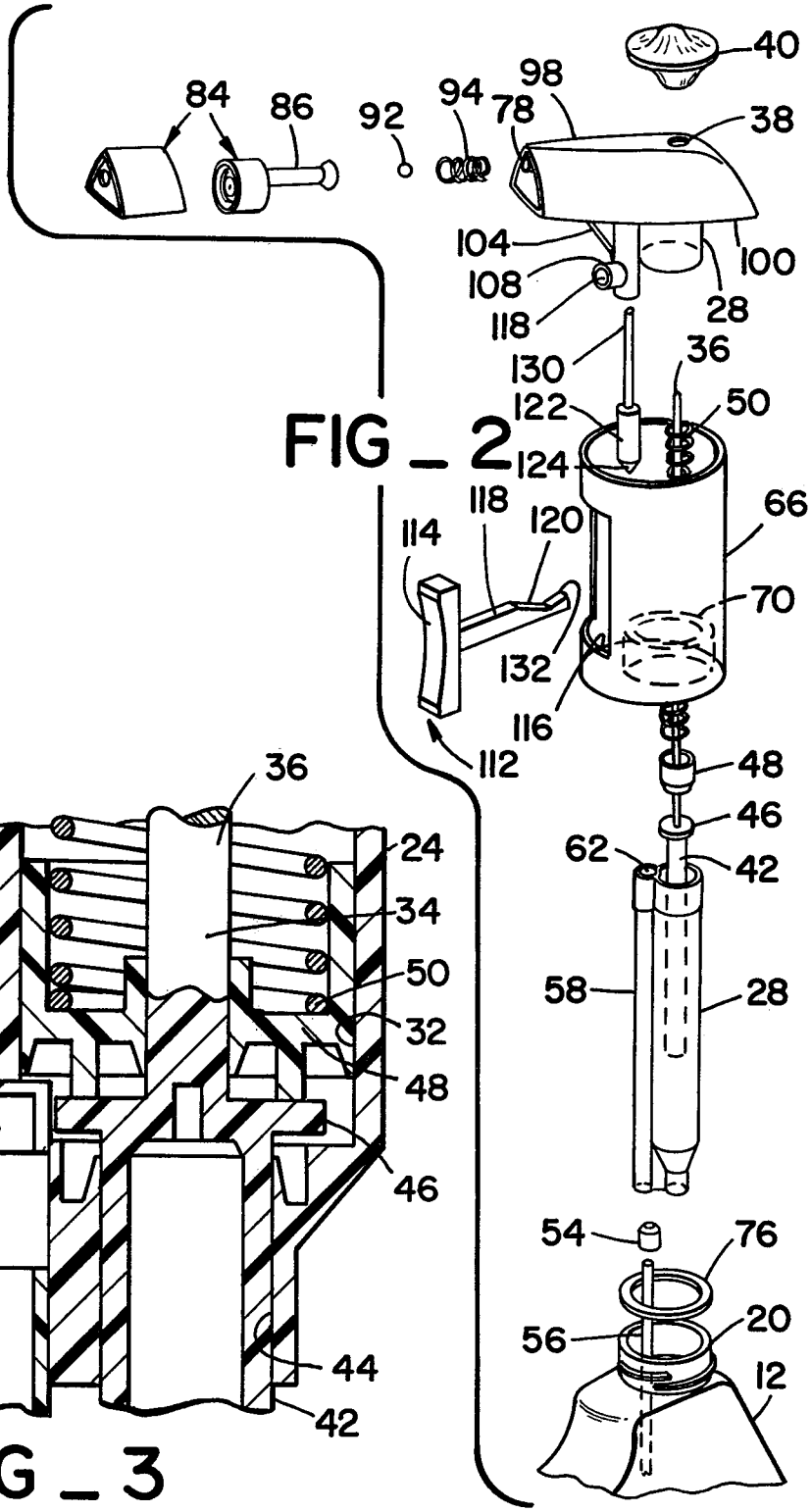
FIG. 2 is an exploded view of the fluid dispenser of the present invention.
Figure 3:
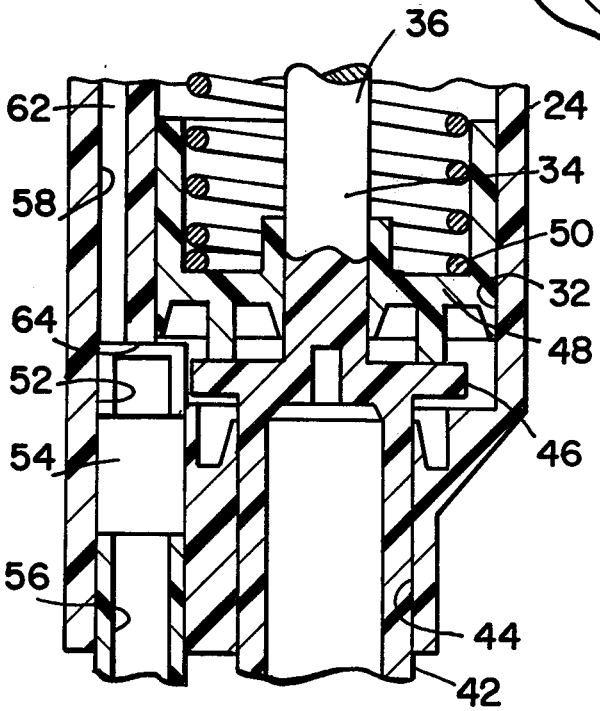
FIG. 3 is an enlarged view of a portion of the dispenser shown in FIG. 1.

Referring to FIG. 1, a manually chargeable fluid dispenser embodying the present invention is shown generally at 10, and comprises a bottle 12 which includes a relatively broad bottom 14 adapted to support the bottle and dispenser device in the usual manner, and a reduced neck 16 having a top surface 18 which is provided with a threaded finish 20 which forms a bottle mouth 22.

Dispensed in bottle mouth 22 is a lower cylinder 24 having an enlarged upper end 26 which receives the lower end of a mating upper cylinder 28 which depends from a spray head body shown generally at 30. Cylinders 24 and 28 cooperate to form a closed charging cylinder 32 which has a charging rod 34 disposed axially therein. The charging rod includes an upper portion 36, having a relatively small diameter, which exits charging cylinder 32 through a bore 38 formed in the spray head body at the end of upper cylinder 28. A handle 40 is attached to the end thereof above the spray head body for manual operation of the charging rod. The charging rod also includes a lower portion 42 which has a larger diameter with respect to upper portion 36, and exits the charging cylinder through a bore 44 provided in the lower end of cylinder 24. A flange 46 is provided on the charging rod at the juncture of the upper and lower portions and is arranged to engage a charging piston 48 slidably disposed on the reduced upper portion 36 of charging rod 34 above flange 46 which is biased thereagainst by a charging spring 50 between the charging piston and the upper end of the charging cylinder.

The lower end of cylinder 24 also includes a bore 52 which has a duck bill valve 54 disposed therein and retained by a dip tube 56 fitted into bore 52 below the check valve. The dip tube extends downward to the lower end of the bottle for communication of fluid therein to the charging cylinder.

Formed integrally in a wall of cylinders 24 and 28 are fluid conduits 58 and 60 respectively which form a fluid passage 62 extending from the bottom of charging cylinder 32, through the mouth of bottle 12 to spray head body 30 adjacent to the top of the charging cylinder. A fluid passage 64 in the wall of cylinder 24 at the lower end thereof communicates bore 52 and fluid passage 62 with charging cylinder 32.

Disposed on top of bottleneck 16 is a cylindrical cap 66 having a lower end 68, a portion of which is formed to define a recessed cylindrical portion 70 having internal threads 72 provided thereon whereby cylindrical portion 70 will threadably engage finish 20 on the bottle. Cylindrical portion 70 also includes means of forming an opening 74 to allow cylinder 24 and fluid conduit 58 formed on the wall thereof to pass through the end of the cap as it exits the bottle. A flexible annular seal 76 is disposed around cylinder 24 and fluid conduit 58 between the top of finish 20 and cylindrical portion 70 of cap 66 for sealing thereof.

Spray head body 30 includes a radial tubular member 78 having an internal bore 80 which forms a fluid discharge passage 82, which intersects and communicates with the upper end of fluid passage 64. A spray nozzle assembly 84 includes a stem 86 which is disposed within bore 80 and has an axial bore 88 provided therein which communicates with bore 80 at the end of stem 86. Stem 86 has a seat 90 provided on the end thereof at the outset of bore 88, for a ball valve 92 which is biased against seat 90 by a valve spring 94 disposed in an inner reduced portion of bore 80.

Spray head body also includes an annular cylinder member 96 arranged to fit over the top of cylinder 66 for mounting of the spray head body thereon.

The spray head body also includes an exterior shroud member 98 which provides a protective enclosure for the other parts of the spray head body and comprises a smooth, elongated member which provides an aesthetic structural continum between the spray nozzle and the bottle and cap.

The shroud member includes a rearwardly projecting support 100 for supporting the entire assembly on the back of a hand gripping the cap.

Depending from tubular member 78 is a tubular member 102 which is supported by a triangular web 104 and has a bore 106 provided therein.

The lower end of tubular member 102 has a short tubular element 108 thereon which projects forwardly at right angles therewith and is provided with an internal bore 110 which intersects bore 106.

A trigger 112 includes a broad, generally rectangular portion 114 disposed in a rectangular cut-out 116 provided in cap 66, and a cylindrical stem 118 which is slidably disposed in bore 110. The distal end of stem 118 has a ramp-shaped cam surface 120 provided thereon which is arranged to engage a piston 122 disposed on bore 106. Piston 122 includes a lower end 124 which is pointed to provide a follower for cam 120, and an upper end 126 which has an annular skirt 128 provided thereon for sealing engagement with the walls of bore 106. Extending upward from the upper end of the piston is a pin 130 which extends upwards through bore 106 and terminates immediately adjacent ball valve 92. The extreme end of trigger stem 118 is provided with a reverse ramp 132 to limit outer travel of the trigger.

In operation, the fluid dispenser described and shown may be grasped with one hand encircling matching cylindrical bottle neck 16 and cap 66 so that the fingers overlay the broad rectangular portion of trigger 112 for immediate actuation thereof. The other hand may grasp handle 40 disposed on the top of charging rod 34 and pull the handle and charging rod upwards against the force of charging spring 50. As the charging rod is pulled vertically upwards, flange 46 on the charging rod pulls piston 48 upwards therewith until charging spring 50 is fully compressed. The larger lower portion 42 of the charging rod will continue to maintain sealing engagement with bore 44 in the lower end of the charging cylinder throughout the upward charging stroke of the charging rod. The retraction of the piston upwards during the charging stroke will create a low pressure in the charging cylinder below the piston, whereupon fluid in the bottle under atmospheric pressure will flow upwards through dip tube 56 and duck bill check valve 54 into the charging cylinder below the piston until the cavity defined thereby is filled with fluid.

Upon release of handle 40, piston 48 will be urged downwardly by charging spring 50 pressurizing fluid in the charging cylinder. Duck bill check valve 54 will prevent escape of fluid in the charging cylinder back down through the dip tube. Fluid will flow up through fluid passages 62 and 64 to ball valve 92 and down through bore 106 to piston 122. The pressurized fluid acting against piston 122 will urge the piston downwards whereupon the lower pointed end of the piston 126 will act against cam surface 120 to extend the trigger outwards until piston 122 reaches its lower limit at a null point 134 on the trigger spring as defined by the intersection of cam 120 and reverse ramp 132. When piston 122 is in such downward position, ball valve 92 will be seated against seat 90 by valve spring 94 preventing pressurized fluid in the charging cylinder, fluid passages 62 and 64, and bore 106 from escaping through bore 88 and nozzle 84.

Pressurized fluid in the charging cylinder will also act on the piston surface of the charging rod which results from the differential size of the upper and lower portions thereof, urging the charging rod downward until flange 46 contacts stop means at the lower end of cylinder 24 in its fully retracted mode.

Pressurized fluid in the charging cylinder may then be selectively released therefrom through the spray nozzle by squeezing trigger 112 and sliding it inwardly in bore 110 whereupon inclined cam surface 120 will urge piston 122 upwardly to unseat ball valve 92 and allow the escape of fluid therepast. However, a pressure drop will be maintained across the ball valve whereby fluid pressure will be maintained in the fluid passages behind the ball valve including bore 106, where it will continue to act on piston 122 to bias it downwardly. Thus, when trigger 112 is released, piston 122 will move downwardly in bore 106 and the lower end thereof will slide down along cam 120, returning the trigger to its original position as defined by engagement of the lower end of piston 122 with null point 134.

Trigger 122 may be repeatedly actuated to release pressurized fluid as desired from the charging cylinder until piston 48 returns to the bottom of the cylinder and fluid therein is exhausted, whereupon the charging stroke of the charging rod may be repeated.

Figure 4:
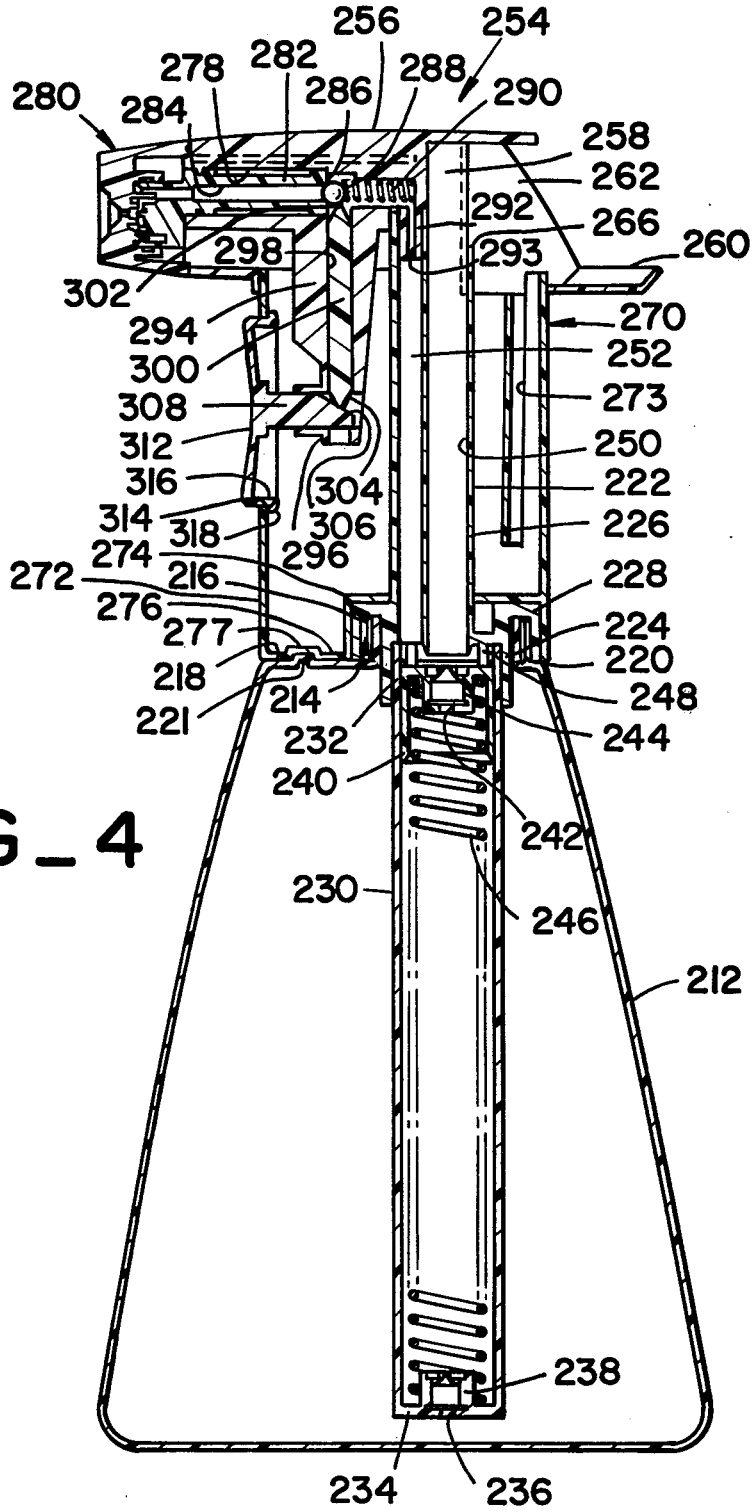
FIG. 4 is a sectional view of an alternative embodiment of the present invention.
Figure 5:
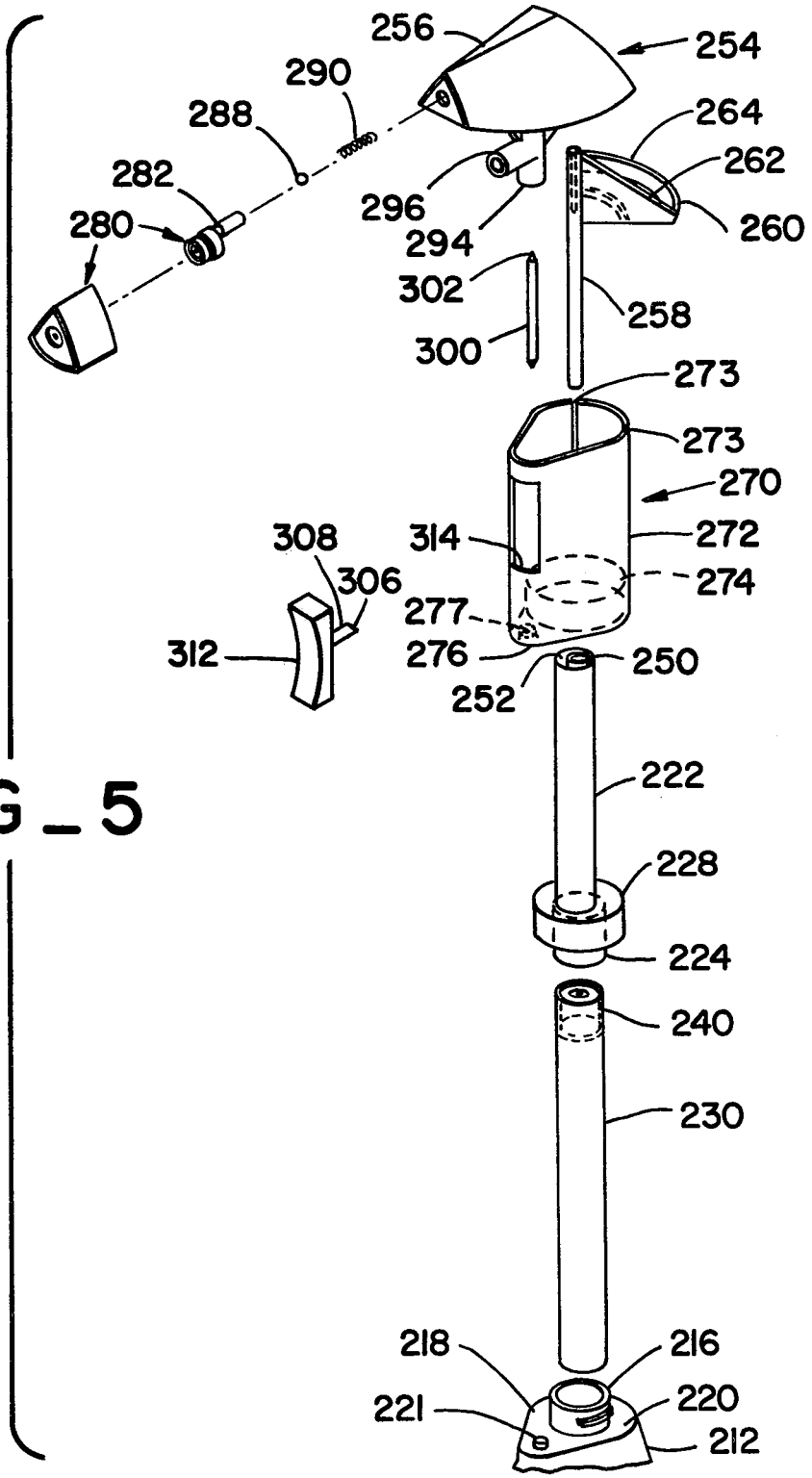
FIG. 5 is an exploded perspective view of the fluid dispenser shown in FIG. 3.

An alternative embodiment of this invention is shown in FIGS. 4 and 5. The fluid dispenser of the embodiment is also mounted on a bottle 212 having a mouth 214 formed by an annular threaded finish 216 upstanding from adjacent front and rear shoulder 218 and 220. A pin 221 is provided on shoulder 218 for rotational locking of a dispenser body disposed thereon.

A draw tube 22 includes a lower cylindrical end 224, a central portion 226 and an annular thread skirt 228 which is adapted for coupling with the threaded finish of bottle 212 whereby cylindrical end 224 depends into the bottle.

A charging tube or cylinder 230 has an open upper end 232 secured within the cylindrical end of the draw tube. The charging tube extends downwardly and terminates in a lower end member 234 which is provided with an inlet port 236 and a duck bill check valve assembly 238.

Slidably disposed within the charging cylinder is a piston 240 having an orifice 242 and a duck bill check valve assembly 244 provided thereon. The piston is biased by a spring 246 towards the upper end of the charging cylinder where it is engageable by an annular stop 248 provided on the lower end of the draw tube to limit upward travel of the piston.

The central portion of the draw tube is provided with a cylindrical bore 250 and a parallel crescent-shaped exit passage 252 for communicating fluid from the charging cylinder to a dispenser or spray head 254, which includes an upper diameter body 256 a portion of which extends over and limits upward travel of a charging rod 258 disposed in bore 250. A tab 260 is attached to the upper end of the charging rod by means of supports 262 and 264 which projects through longitudinal slots 266 and 268 provided in draw tube 222.

A generally cylindrical lower dispneser body 270 is disposed around draw tube 222 between bottle 212 and upper dispenser body 254. The lower dispenser body includes an outer wall member 272 which is an elongated generally cylindrical member that is contoured to serve as a handle for gripping the dispenser and bottle, and has slots 273 to allow sliding of supports 262 and 264 with rod 258. Disposed at the lower end of the lower dispenser body is an internal cylinder 274 arranged to fit tightly over skirt 228 and joined to the outer wall member by a partial bottom wall 276. A socket 277 is provided in wall 276 and arranged to receive pin 221 therein to insure correct alignment of dispenser body 270 on bottle 212.

The spray head construction of the upper dispenser body and the trigger mechanism provided therein are similar to that previously described with respect to the prior embodiment. Upper body 254 has a longitudinally bore 278 extending inwardly thereof from one end which projects forwardly of the lower dispenser body and is fitted with a spray nozzle assembly 280 which includes a nozzle stem 282 which fits tightly within bore 278. Stem 282 has a bore 284 for communicating fluid from bore 278 to the spray nozzle assembly. The inner end of stem 282 forms a valve seat 286 for a ball valve 228 which is biased against the valve seat by a spring 290 and displaceable therefrom by a trigger mechanism described hereinbelow.

Upper body 254 also includes a depending stub 292 that projects into passage 252 and has a bore 293 for communication of fluid from passage 252 to bore 278; and a tubular member 294 which has a tubular element 296 projecting forwardly therefrom at the lower end thereof. A bore 298 is provided in tubular member 294 and arranged so that it axially intersects bore 278 immediately inwardly of nozzle stem 282, adjacent ball valve 288. A trigger cam 300 is slidably disposed in bore 298 and has an upper end 302 which abuts ball valve 288, and a lower end 304 which abuts a ramp 306 provided on a trigger stem 308 which is slidably disposed in a bore 310 provided in tubular element 294. Trigger stem 308 projects rearwardly from a trigger 312 disposed in a congruent opening 314 in lower body 270. The trigger has a rearwardly projecting peripherical skirt 316 which projects through opening 314 and terminates in a flange 318 which is arranged to engage lower body 270 to limit outward extension of the trigger which is biased thereagainst by a fluid pressure acting against cam 300 and trigger stem 308.

Accordingly, the device of the present invention provides a manually charged fluid dispenser in which the charging rod will be returned hydraulically, and thus, does not require operation against the force of a return spring. Charging may thus be effected with lower forces, resulting in increased ease of operation for the user.

The fluid dispenser of the present invention also provides a hydraulically biased trigger linkage which also avoids the need for a trigger biasing spring, and results in a trigger response which is constant throughout actuation of the trigger, and does not increase as the trigger is further actuated, as in the case of the present spring bias trigger linkages.

The fluid dispenser of the present invention also provides a hydraulically biased trigger linkage which also avoids the need for a trigger biasing spring, and results in a trigger response which is constant throughout actuation of the trigger, and does not increase as the trigger is further actuated, as in the case of present spring bias trigger linkages. This also results in lower operating forces and more pleasant operating response. The spray device of the present invention also provides for a trigger actuator which requires a very short actuation stroke, which also enhances ease of operation. The trigger linkage is also aligned both statically and operationally with the fluid discharge spray nozzle to enhance natural orientation and cueing of the spray device prior to and during operation.

What is claimed is:

1. A manually chargeable fluid dispenser comprising,
a charging cylinder,
a piston reciprocable within the cylinder,
an outlet port provided at a first end of the cylinder,
spring means for biasing the piston toward said outlet port extending from a second end of the cylinder,
an inlet port, and
charging rod means for manually sliding the piston in the cylinder against the spring means so that fluid will be drawn into the said first end of the charging cylinder and pressurized by the spring biased piston upon release of the charging rod, further comprising hydraulic means for applying a force of pressurized fluid in said first end of the charging cylinder to the charging rod for providing hydraulic return of the charging rod upon release thereof.

2. The invention defined in claim 1 wherein the charging rod extends axially through the charging cylinder and through the piston and includes a first portion which extends through the first end of the cylinder, and a second portion which extends through the second end of the cylinder, and wherein said hydraulic means comprises a diametric differential between said first and second ends of the charging rod.

3. The invention defined in claim 2 wherein said diametric differential defines a shoulder on said charging rod which is adapted to engage the piston upon manual sliding of the rod in the cylinder to withdraw the piston from the first end toward the second end of the cylinder.

4. The invention defined in claim 3 further including a dispenser head including means for coupling said dispenser head to a bottle, and wherein said second end of the charging cylinder is affixed to said dispenser head, and said charging cylinder depends from the dispenser head so that upon coupling of the dispenser head to a bottle, the first end of the cylinder will be disposed within the bottle.

5. The invention defined in claim 4 further comprising means defining fluid conduit means for communicating fluid from the outlet port to the dispenser head.

6. The invention defined in claim 5 wherein said fluid conduit means comprises a passage provided on the cylinder longitudinally along a side thereof.

7. The fluid dispenser defined in claim 1 further comprising a draw tube secured to said first end of the charging cylinder parallel therewith, an inlet port provided in the second end of the charging cylinder, a check valve in said inlet port, a passageway provided through said piston, and a check valve in said passageway, and wherein said charging rod is slidably disposed in the draw tube and the hydraulic means includes an end surface provided on one end of the charging rod and communication means for communicating pressurized fluid in the charging cylinder to the end surface of the charging rod so that pressurized fluid in the charging cylinder will exert a hydraulic force on the charging rod for hydraulic return thereof.

8. The invention defined in claim 7 further comprising a dispenser head disposed on said draw tube, and fluid conduit means for communicating fluid from the outlet port to the dispenser head.

9. The invention defined in claim 8 wherein said fluid conduit means comprises an exit passage provided in the draw tube.

10. The invention defined in claim 8 wherein said draw tube includes an annular skirt adapted for coupling to a bottle finish so that one end of the draw tube and the charging cylinder will depend into a bottle to which the draw tube is so coupled.

11. The invention defined in claim 1 further comprising a dispenser head, and fluid conduit means for communicating fluid from the outlet port to the dispenser head.

12. The fluid dispenser defined in claim 6, 8 or 11 further comprising means in said dispenser head forming a horizontal tubular member having a bore in communication with said fluid conduit means, a spray nozzle assembly disposed on said spray head assembly and including a stem disposed in said tubular member, said stem having a bore formed therein, means forming a valve seat on said stem at the outlet of the bore formed therein, a ball valve disposed in the tubular member immediately adjacent said valve seat, a spring disposed in the tubular member for biasing the ball valve against the valve seat, and a trigger assembly for operably discharging the ball valve from the seat for releasing pressurized fluid in the fluid conduit and charging cylinder to the spray nozzle assembly.

13. The fluid dispenser defined in claim 12 wherein said trigger assembly comprises a vertical tubular member depending from the horizontal tubular member of said spray head body below the ball valve, said vertical tubular member having a bore formed therein, a horizontal tubular element provided near the distal end of said depending vertical tubular element, said horizontal tubular element having a bore provided therein which intersects the bore in said vertical tubular member, means forming an opening in the wall of the cap, a trigger disposed in said opening in the wall of the cap and including a trigger stem slidably disposed in the bore of the horizontal tubular element, a portion of said stem including means forming a cam surface thereon, a piston slidably disposed in the vertical tubular member, said piston including, a lower end which includes means forming a follower arranged to engage and follow the cam surface of the trigger stem, and an upper end having a pin provided thereon which extends upward to the vertical tubular member to said ball valve, and wherein pressurized fluid in the fluid conduit and horizontal tubular member will be communicated to said vertical tubular member, whereby said fluid pressure will bias said piston and trigger hydraulically with a constant biasing force.

14. The fluid dispenser defined in claim 13 wherein said spray head body includes an annular rim arranged to fit telescopically on the upper edge of said cap, and further comprises a shroud surface enclosing said spray head body, and wherein the horizontal tubular member and spray assembly are aligned parallel with the horizontal tubular element and the reciprocation of the trigger slidable therein, whereby said spray nozzle will discharge fluid released from the dispenser by actuation of the trigger forward of the trigger and parallel to the direction of actuation thereof.

15. The fluid dispenser defined in claim 14 further comprising a reverse ramp surface on the end of the trigger stem, which interests said cam surface, whereby return of the hydraulically biased trigger will be limited by said reverse ramp surface.

16. A manually chargeable fluid dispenser comprising: a charging cylinder including top and bottom end walls joined by side walls, means forming first and second bores in said top and bottom end walls, a charging rod slidably disposed in the charging cylinder and the first and second bores and extending therethrough, said charging rod including an upper end having a first diameter, and a lower end having a second diameter, said second diameter being larger than the first diameter, a piston slidably disposed on the upper end of the charging rod, piston engaging means on said charging rod for engaging the piston and moving it toward the upper end of the cylinder, a charging spring disposed in the cylinder between the piston and the top end of the charging cylinder and biasing the piston against said piston engaging means, means defining a fluid passage for admitting fluid to the charging cylinder at the bottom end thereof, check valve means disposed in said fluid passage for preventing the escape of fluid from the charging cylinder through said fluid passage means, a spray head assembly including manually operable valve means in conduit communication with said charging cylinder for selectively discharging fluid from the charging cylinder, means defining a fluid conduit for communicating the bottom end of the charging cylinder with the spray head assembly for allowing fluid to exit the cylinder, and handle means secured to the upper end of the charging rod above the top wall of the cylinder for manual sliding of the charing rod in the cylinder, wherein said charging rod configuration defines a differential piston surface whereby pressurized fluid in the charging cylinder will act upon said surface to bias the charging rod downward with respect to the charging cylinder.

17. The dispenser defined in claim 11 wherein said piston engaging means comprising a flange provided in the charging rod at the junction of the upper and lower ends thereof.

18. The dispenser defined in claim 17 further comprising a bottle including means forming a bottle mouth defined by an upstanding finish, and a cylindrical cap mounted on the bottle in engagement with the finish, and wherein the spray head assembly includes a spray head body mounted on said cap.

19. The fluid dispenser defined in claim 18 wherein said charging cylinder comprises a lower cylinder portion disposed in the bottle and extending through the mouth thereof, and an upper cylinder portion disposed on the spray head body and depending therefrom, said lower and upper cylinder portions being telescopically coupled together, and wherein said fluid conduit means if formed integrally in the walls of said upper and lower cylinder portions.

20. The fluid dispenser defined in claim 19 wherein said bottle includes a cylindrical neck portion, and said cap is of substantially similar diameter, whereby said neck portion and said cap cooperate to comprise a grip for manually gripping the dispenser.

* * * * *

UNITED STATES PATENT AND TRADEMARK OFFICE

CERTIFICATE OF CORRECTION

PATENT NO. : 4,196,828

DATED : April 8, 1980

INVENTOR(S) : Peter A. Basile et al

It is certified that error appears in the above—identified patent and that said Letters Patent is hereby corrected as shown below:

Col. 3, line 31, "Dispensed" should be --Disposed--;

line 56, after "bill" and before "valve" insert --check--.

Col. 5, line 59, after "shoulder" and before "218" insert --areas--;

line 62, "22" should be --222--.

Col. 6, line 16, "diameter" should be --dispenser--;

line 47, "228" should be --288--.

Signed and Sealed this

*Third* Day of *February 1981*

[SEAL]

*Attest:*

RENE D. TEGTMEYER

*Attesting Officer*

*Acting Commissioner of Patents and Trademarks*